US011457663B2

(12) United States Patent
Xie

(10) Patent No.: US 11,457,663 B2
(45) Date of Patent: Oct. 4, 2022

(54) FLAT HEAT ELEMENT FOR MICROVAPORIZER

(71) Applicants: Donovan Phillips, Richmond, VA (US); James Xu, Richmond, VA (US)

(72) Inventor: Haojun Xie, Guangxi (CN)

(73) Assignees: Donovan Phillips, Richmond, VA (US); James Xu, Richmond, VA (US)

( * ) Notice: Subject to any disclaimer, the term of this patent is extended or adjusted under 35 U.S.C. 154(b) by 0 days.

(21) Appl. No.: 17/272,510

(22) PCT Filed: May 6, 2019

(86) PCT No.: PCT/CN2019/085707

§ 371 (c)(1),
(2) Date: Mar. 1, 2021

(87) PCT Pub. No.: WO2020/223876

PCT Pub. Date: Nov. 12, 2020

(65) Prior Publication Data

US 2022/0117303 A1 Apr. 21, 2022

(51) Int. Cl.
*A24F 40/46* (2020.01)
*A24F 40/48* (2020.01)
(Continued)

(52) U.S. Cl.
CPC ..... *A24F 40/46* (2020.01); *A24F 40/10* (2020.01); *A24F 40/42* (2020.01); *A24F 40/44* (2020.01);
(Continued)

(58) Field of Classification Search
CPC ..... A24F 40/46; A24F 40/10; A24F 40/57; A24F 40/42; A24F 40/40
See application file for complete search history.

(56) References Cited

U.S. PATENT DOCUMENTS 5,322,075 A * 6/1994 Deevi ..... A24F 40/46 131/194
10,440,998 B2 * 10/2019 Polloni ..... A24F 40/30
(Continued)

FOREIGN PATENT DOCUMENTS

CN 107635418 1/2018
CN 108158039 6/2018
(Continued)

OTHER PUBLICATIONS

Extended European Search Reported dated Aug. 18, 2021 issued in European Application No. 19927666.8 (5 pages).
(Continued)

*Primary Examiner* — Hae Moon Hyeon
(74) *Attorney, Agent, or Firm* — Nixon & Vanderhye P.C.

(57) ABSTRACT

A heater assembly (20) is configured to vaporize a liquid. The heater assembly (20) includes a substrate plate (26,28) and a heating element (24) supported on the substrate plate (26,28). The heating element (24) includes a layer of electrically conducting material. The heater assembly (20) further includes a plurality of channels (46) formed by the electrically conducting material. Each of the plurality of channels (46) is configured to operate in parallel. Each channel (46) has an inlet end and an outlet end. The inlet end is configured to receive the liquid and the outlet end is configured to discharge vapor. The substrate plate (26,28) and the heating element (24) form a multi-layer configuration.

21 Claims, 13 Drawing Sheets

(51) Int. Cl.

| | |
|---|---|
| ***A24F 40/10*** | (2020.01) |
| ***A24F 40/44*** | (2020.01) |
| ***A24F 40/57*** | (2020.01) |
| ***A24F 40/42*** | (2020.01) |
| ***H05B 1/02*** | (2006.01) |
| ***H05B 3/26*** | (2006.01) |

(52) U.S. Cl.
CPC ..... *A24F 40/48* (2020.01); *A24F 40/57* (2020.01); *H05B 1/0244* (2013.01); *H05B 3/26* (2013.01); *H05B 2203/005* (2013.01); *H05B 2203/021* (2013.01); *H05B 2203/037* (2013.01)

(56) References Cited

U.S. PATENT DOCUMENTS

| | | | | |
|---|---|---|---|---|
| 10,517,328 | B2 * | 12/2019 | Polloni | A24F 40/70 |
| 11,083,856 | B2 * | 8/2021 | Buchberger | A24F 40/485 |
| 2016/0366944 | A1 | 12/2016 | Larson | |
| 2017/0172206 | A1 | 6/2017 | Barkley | |
| 2021/0100286 | A1 * | 4/2021 | Sudlow | A61M 11/04 |

FOREIGN PATENT DOCUMENTS

| | | | |
|---|---|---|---|
| CN | 109549253 | | 4/2019 |
| CN | 109549255 | | 4/2019 |
| WO | 2016/172448 | A1 | 10/2016 |
| WO | 2018/167166 | A1 | 6/2017 |
| WO | 2018/083007 | | 5/2018 |

OTHER PUBLICATIONS

International Search Report for PCT/CN2019/085707 dated Jan. 31, 2020, 4 pages.
Written Opinion of the ISA for PCT/CN2019/085707 dated Jan. 31, 2020, 4 pages.

* cited by examiner

FLAT HEAT ELEMENT FOR MICROVAPORIZER

This application is the U.S. national phase of International Application No. PCT/CN2019/085707 filed May 6, 2019 which designated the U.S., the entire contents of each of which are hereby incorporated by reference.

(1) FIELD OF THE INVENTION

The invention relates to a heater for microvaporizer, and particularly to an electrically heated element incorporated into a cartridge for the microvaporizer.

(2) DESCRIPTION OF RELATED ART

Microvaporizers, also referred to as vaping devices, provide alternatives to cigarettes, cigars, pipes and other tobacco smoking devices. Vaping devices may be configured to provide the sensations associated with cigarette, cigar, or pipe smoking, but without delivering considerable quantities of incomplete combustion and pyrolysis products that result from the burning of tobacco. Microvaporizers may also be configured to deliver medicinal aerosols, such as asthma breathers.

Conventional microvaporizer heaters typically include a coiled heating wire is wrapped around a wick that draws a liquid infused with chemicals (such as nicotine) from a reservoir. Coiled heating wires heat the liquid in the wick, which may not all be vaporized. Thus, the coiled heating wires are inefficient in that the heat more liquid than is needed to create the aerosol. Further, coiled heating wires heat the outer surface of the wick to a greater extent than the interior of the wick and my not uniformly heat the surface of the wick. Thus, the coiled heating wire design may lead to inconsistent heating of the liquid which affects the size(s) of particles in the aerosol formed by heating the wick. The taste and user experience of inhaling the aerosol may be adversely affected by many variables such as inconsistent heating, surface area and aerosol particles of varying sizes.

In addition, the conventional coiled heating wire and wick heats the entire wick within the coil. Thus, there is only one operable heating zone.

(3) BRIEF SUMMARY OF THE INVENTION

The conventional coiled heating wire is incapable of utilizing multi-zone heating, and must vary the magnitude of electrical power applied to the coil in order to regulate the temperature of the liquid flowing through the microvaporizer. The single-zone configuration has less control over the temperature of the liquid in the microvaporizer and allows for greater fluctuations in temperature, which in turn leads to greater fluctuations in particle size within the aerosol.

The flat heater described herein attempts to improve the deficiencies of the conventional design. For example, the flat heater is a simpler design that uses less material and can regulate the amount of heat applied to the liquid. Because the flat heater can control the amount heat applied to the liquid, the flat heater can control the size of particles in the aerosol and can even produce different predetermined particle sizes within an aerosol mixture. For example, for nicotine absorption smaller vapor dimensions (particle size) allow nicotine to flow deep into the lung. At the same time, larger particle dimensions are better at activating taste buds on the tongue. Unlike conventional microvaporizer heaters, the flat heater described herein can generate both particle sizes with consistency.

In addition, because the flat heater can regulate the amount of heat, the flat heater can avoid reaching temperatures that produce certain carcinogens.

In a first aspect of the technology, a heater assembly may be configured to vaporize a liquid. The heater assembly may include a substrate plate and a heating element supported on the substrate plate.

The heating element may include a layer of electrically conducting material with a plurality of channels formed by the electrically conducting material. Each of the plurality of channels may be configured to operate in parallel. Each channel may have an inlet end and an outlet end. The inlet end may be configured to receive the liquid and the outlet end may be configured to discharge vapor. The substrate plate and the heating element may form a multi-layer configuration.

The electrically conducting material may be configured so that the electrical resistivity of the heating element is greater at the outlet ends the channels than at the inlet ends of the channels.

The electrically conducting material may be configured to generate a greater amount of heat at the outlet ends of the channels than at the inlet ends of the channels.

The plurality of channels may be divided into heating groups that are independently controllable.

Each group of channels may be energized based on a user's demand.

Each group of conduits may be configured to achieve a respective range of target temperatures.

Each respective range of target temperatures may be different.

Each respective range of target temperatures may overlap another respective range of target temperatures.

The heater may be configured to generate an aerosol with a target particle size.

The heater may be configured to generate an aerosol with more than one target particle size.

The electrically conducting material may be a metal. In addition, the substrate plate may be glass or acrylic.

In another aspect of the technology, a cartridge for microvaporizer may be configured to generate an aerosol from a liquid supply. The cartridge may include a mouth piece configured to deliver the aerosol to a user's airways and a reservoir configured to retain the liquid supply. The cartridge may also include the heater assembly discussed above.

In yet another aspect of the technology, a heater assembly may be configured to vaporize a liquid and may include a substrate plate and a heating element supported on the substrate plate. The heating element may include a layer of electrically conducting material with a plurality of elongated gaps that are configured to convey a fluid. The substrate plate may cover a first section of each elongated gap. In addition, the substrate plate may include an opening that leaves a second section of each elongated gap exposed. The heating element may be configured to heat the fluid in the first sections of the elongated gaps to a temperature below the vapor transition temperature of the fluid. Also, the heating element is configured to heat the fluid in the second sections of the elongated gaps to a temperature above the vapor transition temperature of the fluid.

The heating element may be configured to vaporize the fluid in each elongated gap before the fluid reaches the second section of the elongated gap.

The elongated gaps may be separated from each other by strips of the electrically conducting material.

The strips of electrically conducting material may be wider at the first sections of the elongated gaps than at the second sections of the elongated gaps.

The substrate plate may be electrically insulating.

The elongated gaps may be linearly shaped and are positioned in parallel.

The elongated gaps may be fluidly connected to a common inlet.

A wick may be positioned within the elongated gaps.

A wick may be positioned across outlet ends of the elongated gaps.

The channels may be directed radially toward a center of the heating element.

In yet another aspect of the technology, a cartridge for microvaporizer may be configured to generate an aerosol from a liquid supply. The cartridge may include a mouth piece configured to deliver the aerosol to a user's airways and a reservoir configured to retain the liquid supply. The cartridge may also include the heater assembly discussed above.

In yet another aspect of the technology, a heater assembly may be configured to vaporize a liquid. The heater assembly may include a first substrate plate, a second substrate plate, and a heating element sandwiched between the first and second substrate plate. The heating element may include a layer of electrically conducting material with a plurality of elongated gaps that are configured to convey a fluid. The first substrate plate may partially cover the plurality of elongated gaps to form elongated channels. The heating element may include a plurality of independently controlled heating zones. In addition, each elongated channel may be configured to heat the fluid in a multi-stage heating process.

The electrically conducting material may be configured so that the electrical resistivity of the heating element at one end of each elongated channel is different from the electrical resistivity at the other end of the elongated channel.

Each elongated channel may be configured so that liquid toward an inlet of the elongated channel is subject to a first stage of heating at a first temperature and liquid toward an outlet of the elongated channel is subject to a second stage of heating at a second temperature that is greater than the temperature generated in the first stage of heating.

The temperature generated in the first stage of heating may be below the vapor transition temperature of the fluid, and the temperature generated in the second stage of heating may be above the vapor transition temperature.

Each heating zone may include a plurality of the elongated channels.

Heating zone may be configured to be energized based on a user's demand.

Each heating zone may be configured to achieve a respective range of target temperatures.

Each respective range of target temperatures may be different.

Each respective range of target temperatures may overlap another respective range of target temperatures.

The heater may be configured to generate an aerosol with a target particle size.

The heater may be configured to generate an aerosol with more than one target particle size.

In yet another aspect of the technology, a cartridge for microvaporizer may be configured to generate an aerosol from a liquid supply. The cartridge may include a mouth piece configured to deliver the aerosol to a user's airways and a reservoir configured to retain the liquid supply. The cartridge may also include the heater assembly discussed above.

DETAILED DESCRIPTION OF THE INVENTION

Figure 1:
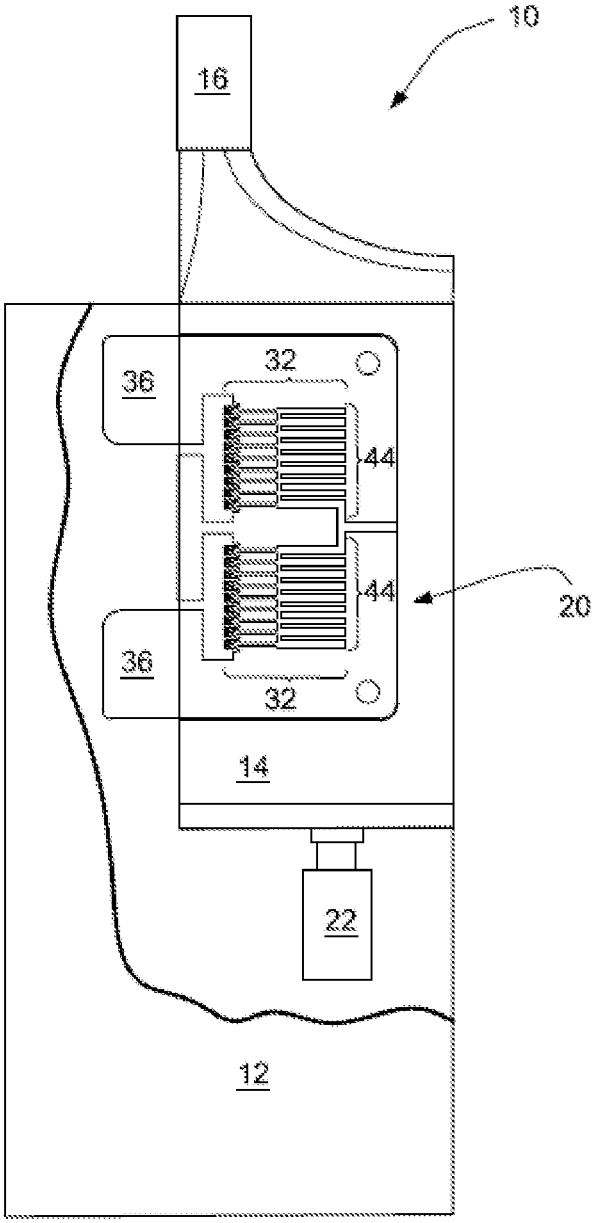
FIG. 1 is sectional view of an exemplary microvaporizer including a base, a cartridge and a heater.

FIG. 1 shows an exemplary microvaporizing device 10 for generating an aerosol for inhalation by a user. The microvaporizing device 10 may include a base 12 and a cartridge 14. The base 12, may be configured to receive one of a plurality of interchangeable cartridges 14 and may house a power source, such as a battery and/or electronics. The cartridge 14 may include a mouthpiece 16 for delivering the aerosol directly to the user's mouth and may include a mount (e.g., recess 18—see FIG. 2) for a heater 20. The power supply may provide electrical power to the heater 20 and the electronics may control the electrical energy supplied the heater 20. In addition, a storage tank or reservoir for fluid to be vaporized may be housed in the base 12 and/or in the cartridge 14. The cartridge 14 may also include a pump 22 to pump the fluid from the reservoir through the cartridge 14. The cartridge 14 may be permanently attached to the base 12 or releasably attached to the base 12.

Figure 2:
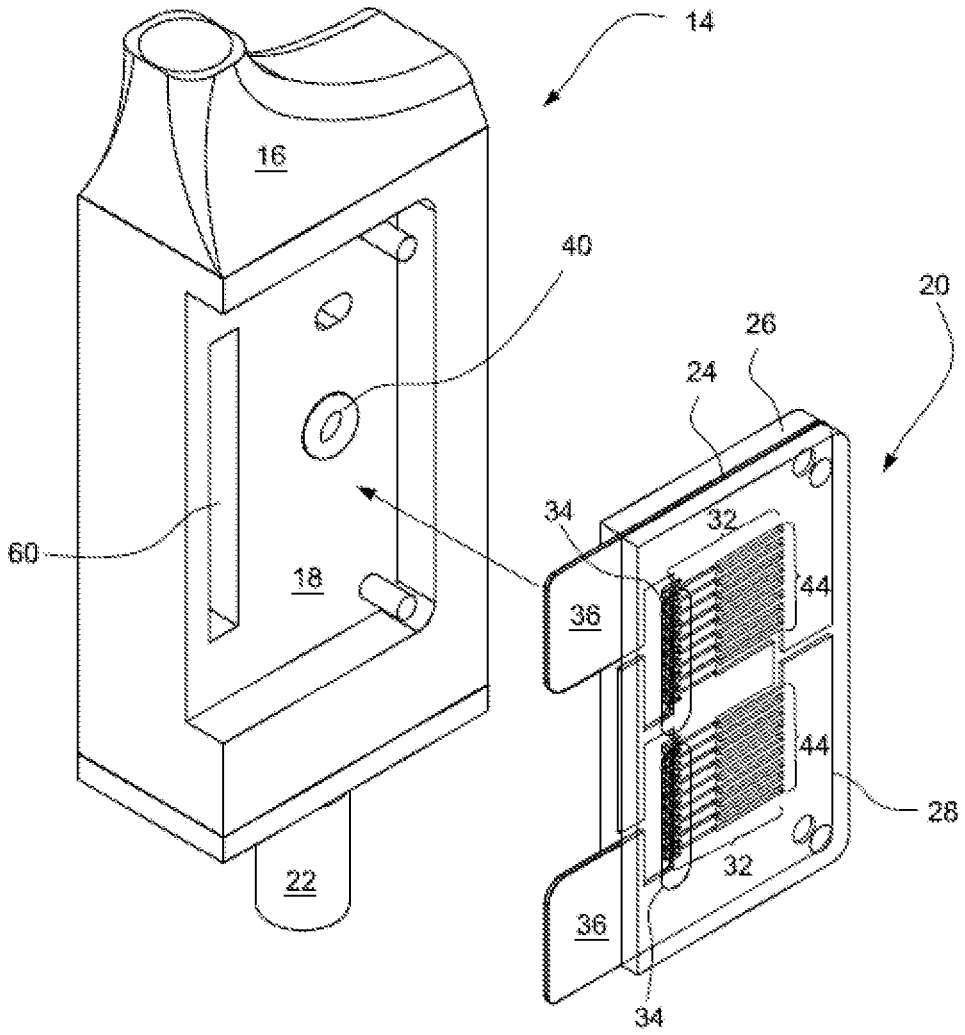
FIG. 2 is a perspective view of the cartridge and heater of FIG. 1.

As shown in FIG. 2, the heater 20 may be mounted to the cartridge by being received within the recess 18 in the cartridge 14. The heater 20 may generate the heat necessary for heating and vaporizing the fluid (or transforming the fluid into an aerosol to be delivered to the user's airways). The configuration or structure of the heater 20 may induce the fluid to flow through the cartridge 14 by way of, for example, capillary action. In some configurations, the heater 20 may be able to draw the fluid through the cartridge 14 without the need for the pump 22.

Figure 3:
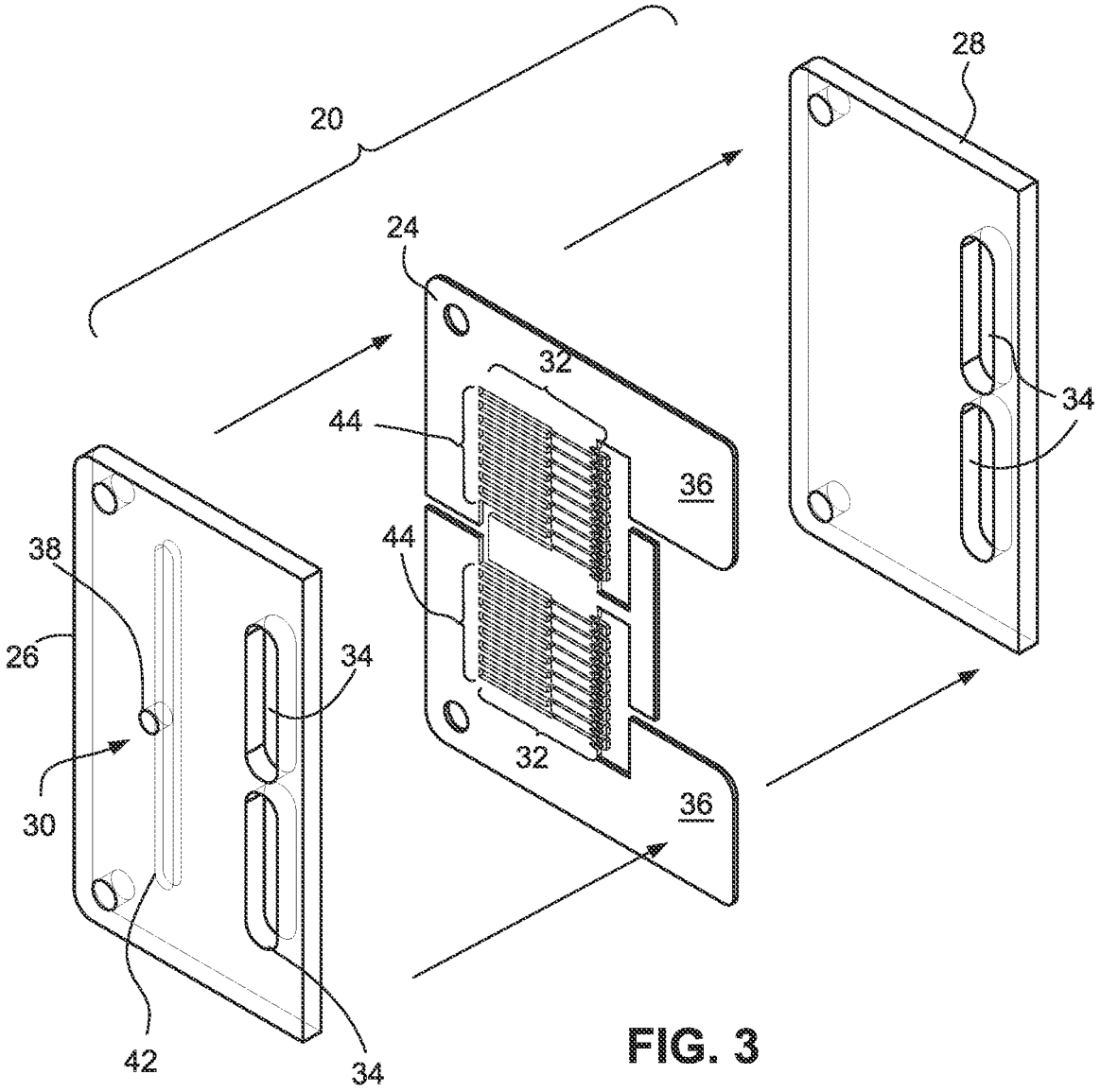
FIG. 3 is an exploded view of the heater of FIG. 1.
Figure 4:
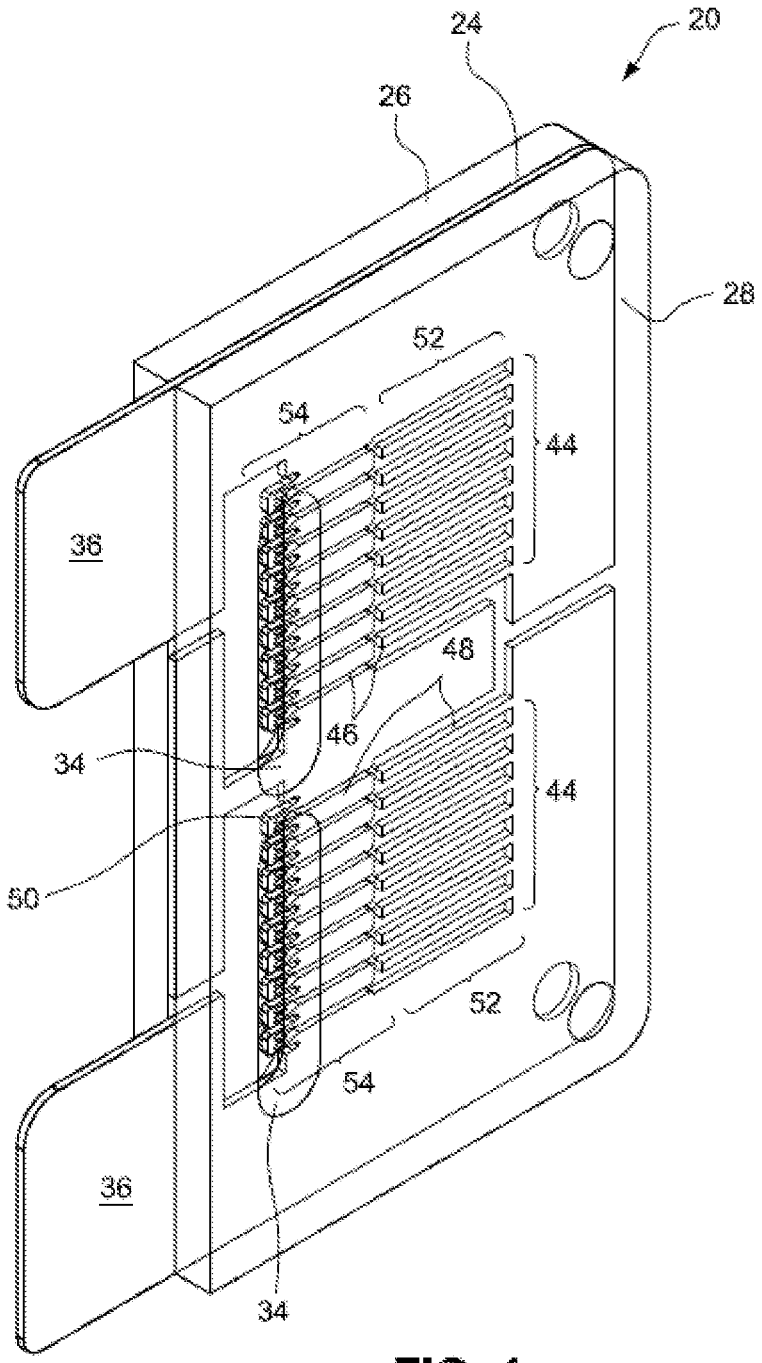
FIG. 4 is a perspective view of the heater of FIG. 1.

As can be seen in FIGS. 2-4, the heater 20 may include a flat heating element 24 sandwiched between an inner substrate plate 26 and an outer substrate plate 28. The inner substrate plate 26 and the outer substrate plate 28 may be arranged so that when the heater 20 is mounted to the recess 18, the inner substrate plate 26 may be positioned against a recessed wall of the recess 18 while the outer substrate plate 28 faces outwardly. It is contemplated that the flat heating element 24 may be made from electrically conducting material such as, for example, a metal or semiconductor. Different parts of the flat heating element 24 may be made of different types of material with different electrically conducting characteristics. In addition, the overall shape and the individual components of the flat heating element 24 may be carved, cut, punched, or etched from a blank.

The substrate plates 26, 28 may be transparent to show the flat heating element 24. The transparency of the substrate plates 26, 28 may facilitate a visual inspection of the operation of the heater 20. The substrates 26, 28 may be flat panels formed of glass, plastic, acrylic, or other material which may be non-conductive or a dielectric. Together, the flat heating element 24 and the inner and outer substrate plates 26, 28 may form a flat heater with a multi-layer configuration (e.g., a heating element sandwiched between two substrate plates).

The heater 20 may include an inlet passage 30 for receiving fluid from the storage tank or reservoir, a vaporizing section 32 for vaporizing the fluid, and one or more outlet passages 34 in the inner substrate plate 26 for discharging the vaporized fluid toward the mouthpiece 16 of the cartridge 14. Optionally, the outer substrate plate 28 may also include one or more outlet passages 34. The heater 20 may also include one or more electrical contacts 36 that may provide a conduit for electric power and communication between the heater 20 and the power supply and electronics in the base 12.

The inlet passage 30 of the heater 20 may receive the fluid from the storage tank or reservoir and may traverse the thickness of the inner substrate plate 26. An intake portion 38 of the inlet passage 30 may be shaped and sized to sealingly engage an opening 40 in a wall of the cartridge 14 (see FIGS. 2 and 3). The inlet passage 30 may terminate at a discharge portion 42 that opens up to the vaporizing section 32 of the heater 20. The discharge portion 42 may have a different shape and size than the intake portion 38. For example, the discharge portion 42 may be larger than the intake portion 38.

The flat heating element 24 may include alternating rows 44 of fluid passages (or gaps) 46 and strips of material 48 (also referred to as metallic strips or heating elements). Each strip 48 may be connected to an adjacent strip 48 by a conductive loop 50. The fluid passages 46, the strips 48 and the loops 50 may form the bulk of the vaporizing section 32. In addition, the fluid passages 46 and the loops 50 may form elongated gaps (or elongated channels) 51 in the electrically conducting material.

The vaporizing section 32 may be divided into a fluid distribution zone 52 adjacent the inlet passage 30 and a transition zone 54 adjacent the outlet passage 34. The fluid may enter the vaporizing section 32 by way of the inlet passage 30. As such, the discharge portion 42 of the inlet passage 30 may extend across all of the fluid passages 46 in the fluid distribution zone 52 so that all of the fluid passages 46 may receive the fluid directly from the inlet passage 30. In addition, the portions of the fluid passages 46 in the fluid distribution zone 52 may be fluidly connected to each other by a common fluid passage (or transverse fluid passage) 56. The common fluid passage 56 may extend across all of the fluid passages 46 so that excess fluid in one fluid passage 46 may be directed to another fluid passage 46 that has available capacity. The fluid distribution zone 52 may help account for an uneven distribution of fluid from the discharge portion 42 of the inlet passage 30 due to the orientation of the cartridge. The fluid distribution zone 52 may also help account for uneven consumption of fluid due to different rates of vaporization in different fluid passages 46. It is contemplated that the discharge portion 42 of the inlet passage 30 may extend across only some of the fluid passages 46 or may be fluidly connected to only one fluid passage 46.

The transition zone 54 of the vaporizing section 32 may facilitate the transition of the fluid from liquid to vapor. Upon entering the transition zone 54 from the fluid distribution zone 52, the fluid may be heated (or pre-heated) by the strips 48. It is contemplated that the fluid, to a lesser extent, may also be heated by the portions of the strips 48 in the fluid distribution zone 52. In addition, the amount of heat directed to the fluid in the fluid passages may be limited so that the fluid remains in the liquid state while flowing through the fluid passages 46.

Each fluid passage 46 may discharge the heated fluid (in liquid form) into an open area 58 defined by an inner edge of a corresponding loop 50. The loops 50 may be sized so that the open areas 58 receive a small amount of fluid. In addition, part of each loop 50 may extend into the outlet passage 34 so that only part of the open area 58 is covered by the inner and outer substrate plates 26, 28.

The transition from liquid to vapor may occur in the portion of the open area 58 covered by the inner and outer substrate plates 26, 28. The heat generated by the loop 50 may cause a bubble to form at the edge of the outlet passage 34 so that by the time the fluid reaches the outlet passage 34, the fluid is completely converted to vapor and no liquid leaks out of the outlet passage 34. Once in vapor form, the fluid may flow through the outlet passage 34 to the mouthpiece 16 by way of the opening 60 in the recess 18.

It is contemplated that the open areas 58 may be sized to trap any liquid reaching the outlet passage 34 (e.g., by way of surface tension) so that such liquid does not leak into the mouthpiece 16. Accordingly, the open areas 58 of the loops 50 may have an area, for example, of two, one or less square millimeters.

Movement of the fluid through the fluid passages 46 may be generated by a pressure difference with each fluid passage 46. The pressure difference may be caused a user inhaling the vapor through the mouthpiece 16. The movement of the vapor through the outlet passage 34 may lower the pressure in the fluid passages 46, thereby causing a pressure drop within the fluid passages 46. Movement of the fluid through the fluid passages 46 may also be caused by capillary action within the fluid passages 46. It is contemplated that the pressure differential may also be generated by the pump 22 in the cartridge 14. Also, a wicking material may be positioned within each fluid passage 46, thereby drawing fluid through the fluid passages 46 by way of a wicking action. It should be understood that the source of the force moving the fluid through the fluid passages 46 may not be limited to the examples discussed above and that other sources may provide the force needed to drive the fluid through the fluid passages 46.

The strips 48 and the loops 50 may generate heat by way of resistance heating. It is further contemplated that the heater 20 may utilize multi-stage heating in which the fluid flowing through the fluid passages 46 receives increasing levels of heat as the fluid flows from the inlet passage 30 to the outlet passage 34. Given that the amount of heat generated in a resistance heater depends on the magnitude of the electrical resistivity in the material to which electricity is applied, for multi-stage heating, the strips 48 may have a different electrical resistivity value than the loops 50. In particular, the loops 50 may have a greater resistivity than the strips 48.

Figure 5A:
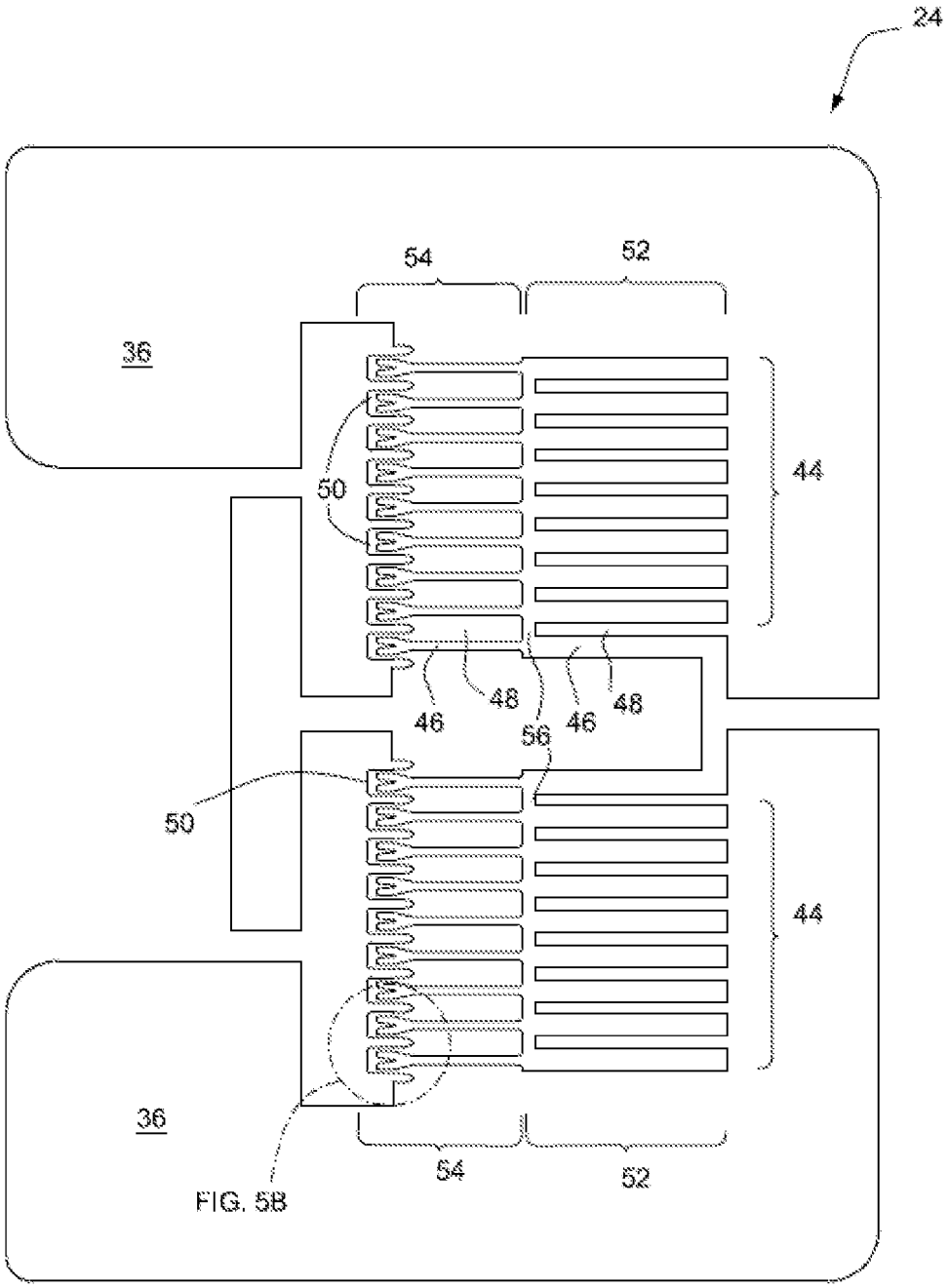
FIG. 5A is a plan view of a metallic heating element of the heater of FIG. 1.
Figure 5B:
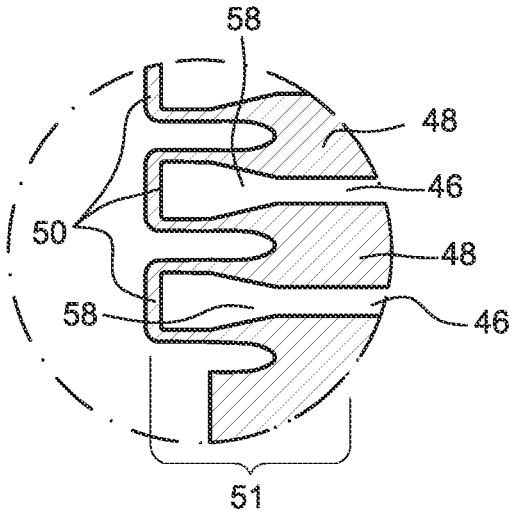
FIG. 5B is a plan view of a section of the metallic heating element of FIG. 5A.

One way of achieving different electrical resistivities is to vary the width (or cross-sectional shape) of the electrically conducting material. For example, as shown in FIGS. 4-5B, the electrically conducting material forming the loops 50 may be thinner (or have a smaller cross-section) than the electrically conducting material of the strips 48. Accordingly, the strips 48 may have a smaller electrical resistivity and may generate a smaller amount of heat than the loops 50.

Multi-stage heating for each fluid passage 46 may allow for better control over the temperatures applied to the fluid flowing through the transition zone 5. Since different temperatures generate different particle sizes when forming an aerosol, better control over the temperature may allow for better control over the size of the particles formed in the aerosol generated by vaporizing the fluid in the heater 20. Different particle sizes are desired depending on the use of the microvaporizer 10. For example, nicotine absorption requires smaller particle sizes for absorption in the user's lungs, while larger particle sizes improve the taste of the aerosol.

In addition to multi-stage heating within each fluid passage 46, the transition zone 54 may also have multi-zone heating across different rows 44 of fluid passages 46, strips 48 and loops 50. In particular, the different rows 44 may be segmented into separately actuated groups. Accordingly, not only can the amount of heating be controlled by staging the amount of heat applied to each fluid passage 46, the amount of heat can also be controlled by actuating one, some or all of the separately actuated groups of rows 44. Each group of rows 44 may be associated with a particular heating temperature range and/or electrical resistivity range. Also, the electrical current applied to each group of rows 44 may be selected to achieve a desired heating of the fluid in the respective fluid passages 46 and open areas 58.

The multi-zone heating across the different rows 44 may allow for the controlled generation of different sized particles within a common aerosol. As discussed above, nicotine absorption requires smaller particle sizes, while larger particle sizes improve the taste of the aerosol. Multi-zone heating across the different rows 44 may generate more than one particle size, thereby addressing the multiple particle size needs for a nicotine infused aerosol.

Multi-zone heating may also increase the efficiency of the heater 20 by tailoring the amount of heating to the user's demand. For example, if the flow of aerosol inhaled by the user is low, only one or two groups of rows 44 may be activated to generate heat. If the user inhales more aerosol, more groups of rows 44 may be activated to generate more heat. Thus, utilizing multi-zone heating across different rows 44 can reduce the average amount of electrical power drawn by the heater 20 by only utilizing the number of rows 44 required by the user's demand.

Alternatively, the transition zone 54 of the vaporizing section 32 may utilize single-stage heating. For single-stage heating, the widths (or cross-sectional shapes) of the electrically conducting material of the strips 48 and the loops 50 may be the same. Accordingly, the electrical resistivities of the strips 48 and the loops 50 may be the same and the amount of heat generated by the strips 48 and the loops 50 may be the same.

Figure 6:
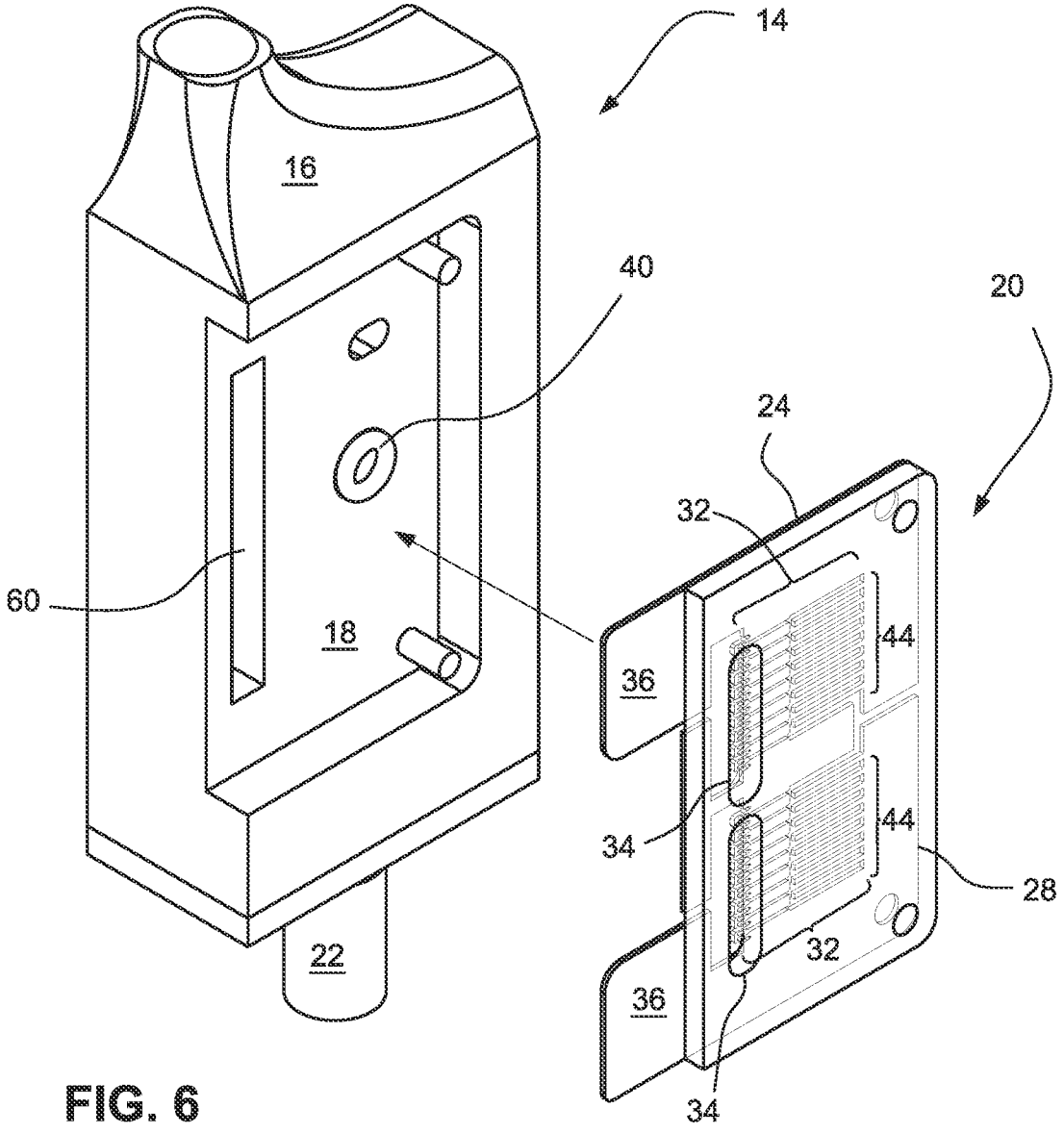
FIG. 6 is a perspective view of another cartridge and heater.
Figure 7:
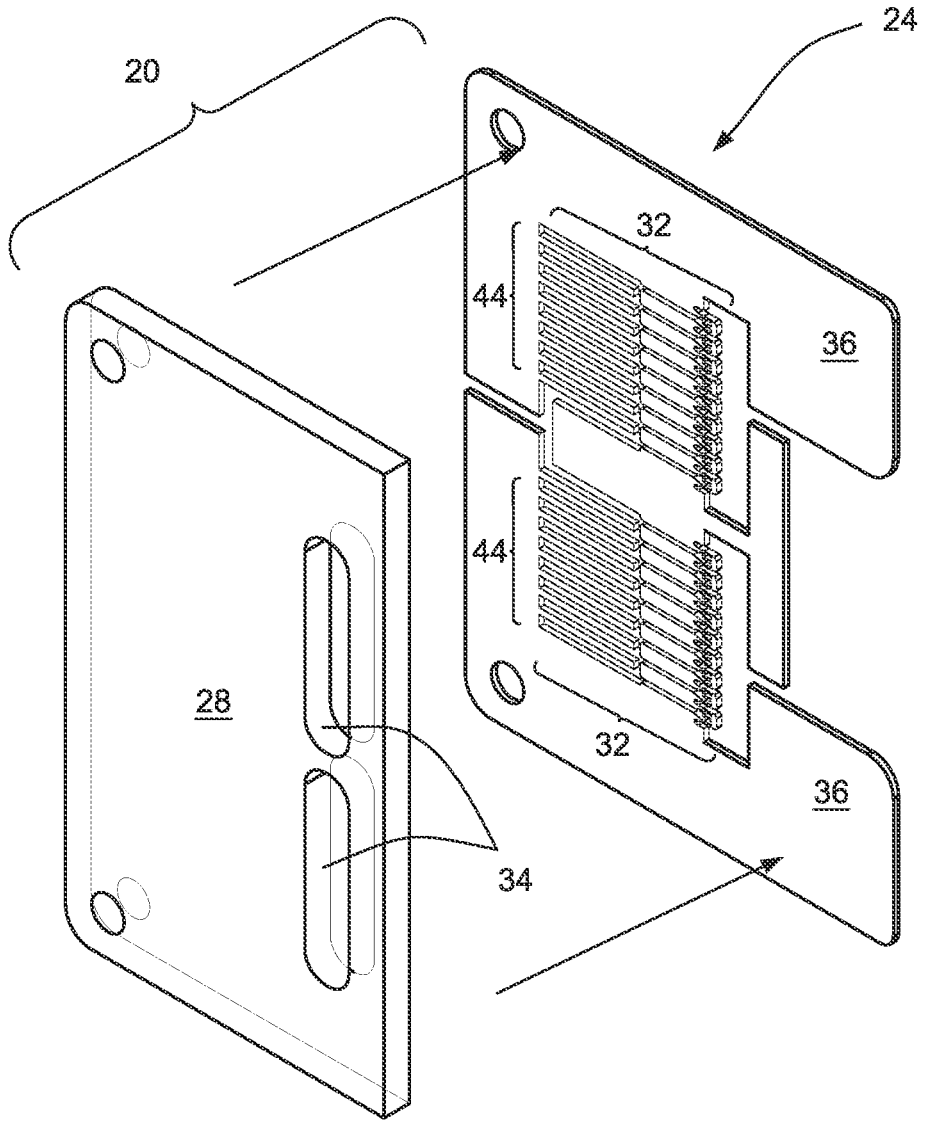
FIG. 7 is an exploded view of the cartridge and heater of FIG. 6.

FIGS. 6 and 7 illustrate an exemplary configuration in which the heating element 24 is mounted on only one substrate 28. In this configuration, when the heater 20 is mounted within the recess 18, the fluid passages 46 may be enclosed by the recess wall and the outer substrate 28. This configuration may operate in substantially the same way as the configuration utilizing two substrates.

Figure 8:
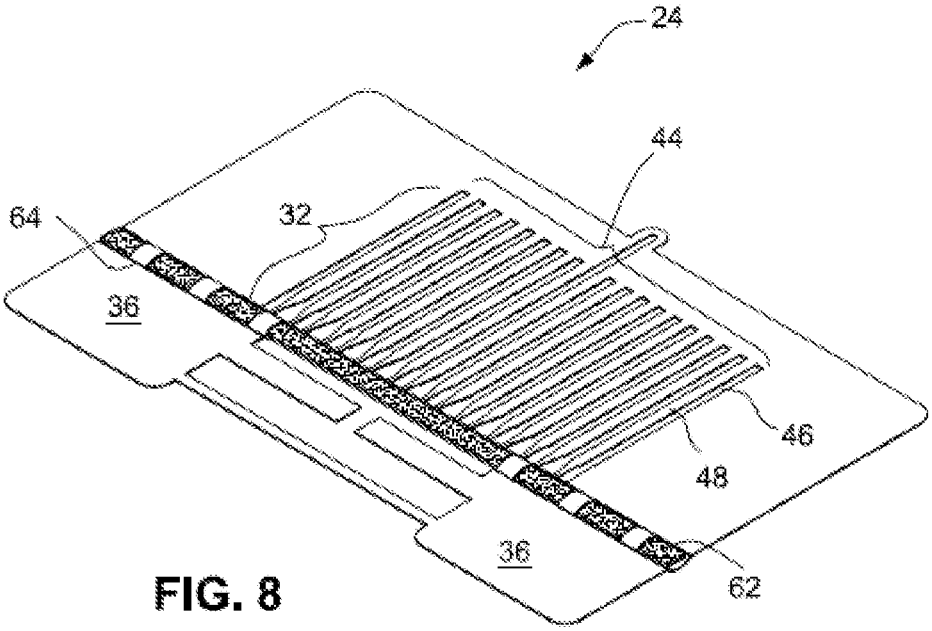
FIG. 8 is perspective view of a further heating element.
Figure 9A:
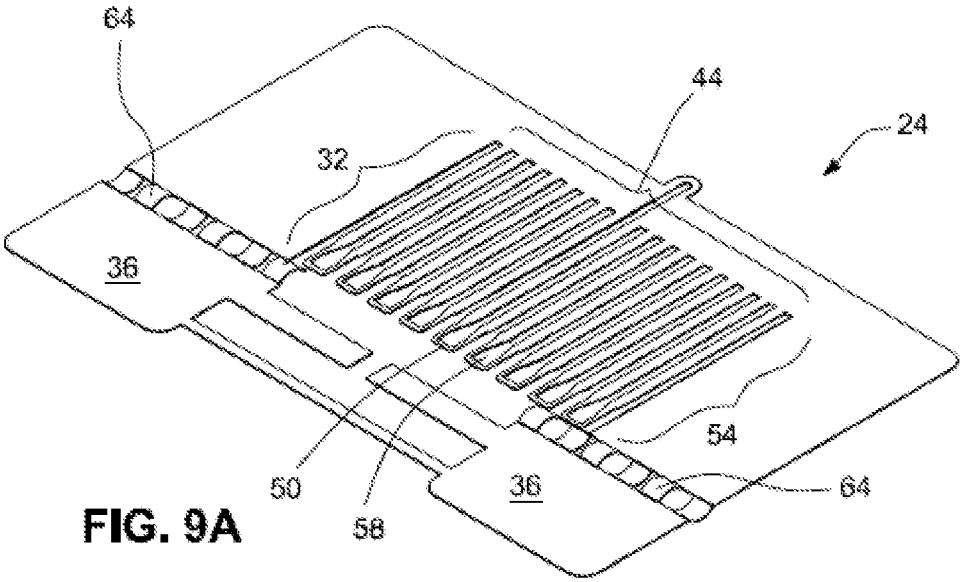
FIG. 9A is another perspective view of the heating element of FIG. 8.
Figure 9B:
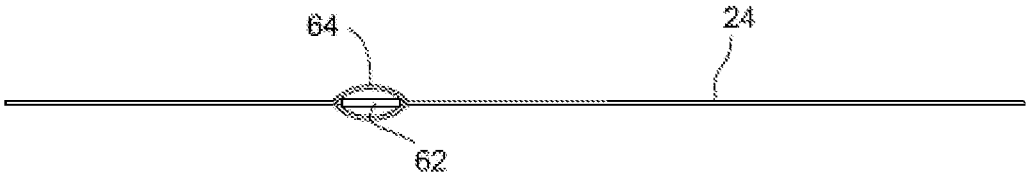
FIG. 9B is a side view of the heating element of FIG. 8.

Another aspect of the technology is illustrated in FIGS. 8 to 9B. As can be seen, the heating element 24 may include a wick 62 to help draw the fluid through the fluid passages 46 and the open areas 58. The wick 62 may be held in place by a wick holder 64 and may extend across all or some of the rows 44. It is contemplated that the loops 50 may overlap the wick 62 so that the wick 62 is in contact with the fluid in the open areas 58 within the loops 50. FIGS. 8 and 9A illustrate the vaporizing section 32 as only including the transition zone 54 because the absorbing ability of the wick 62 may function as a replacement for the fluid distribution zone 52. However, it should be understood, that the vaporizing section 32 in the configuration utilizing the wick 62 may include the fluid distribution zone 52. It is contemplated that multiple wicks 62 may be located in each individual fluid passage 46 in addition to (or instead of) the location shown in FIGS. 8 and 9A.

Figure 10:
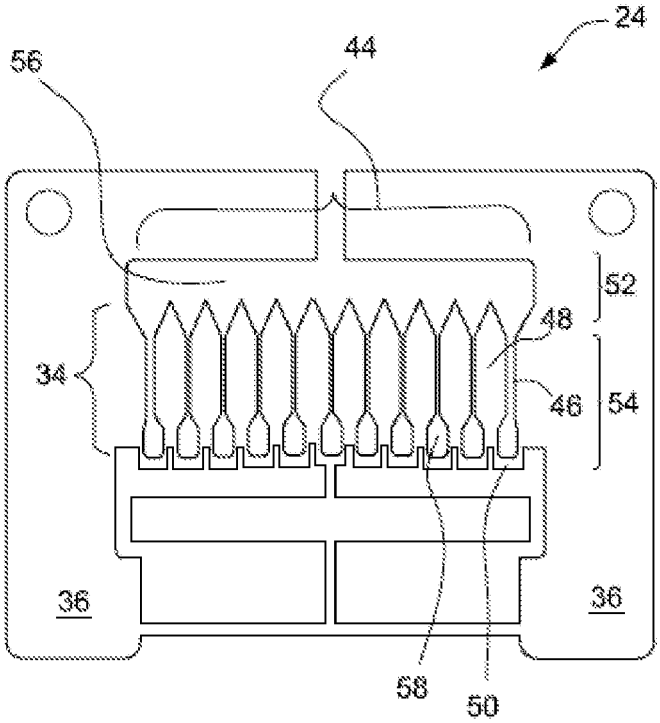
FIG. 10 shows a plan view of an exemplary heater.

FIG. 10 illustrates a heating element 20 in which the common fluid passage 56 receives the fluid directly from the opening 40. As such, the only fluid passage in the fluid distribution zone 52 may be the common fluid passage 56. The entirety of the fluid passages 46 may be within the transition zone 54.

Figure 11:
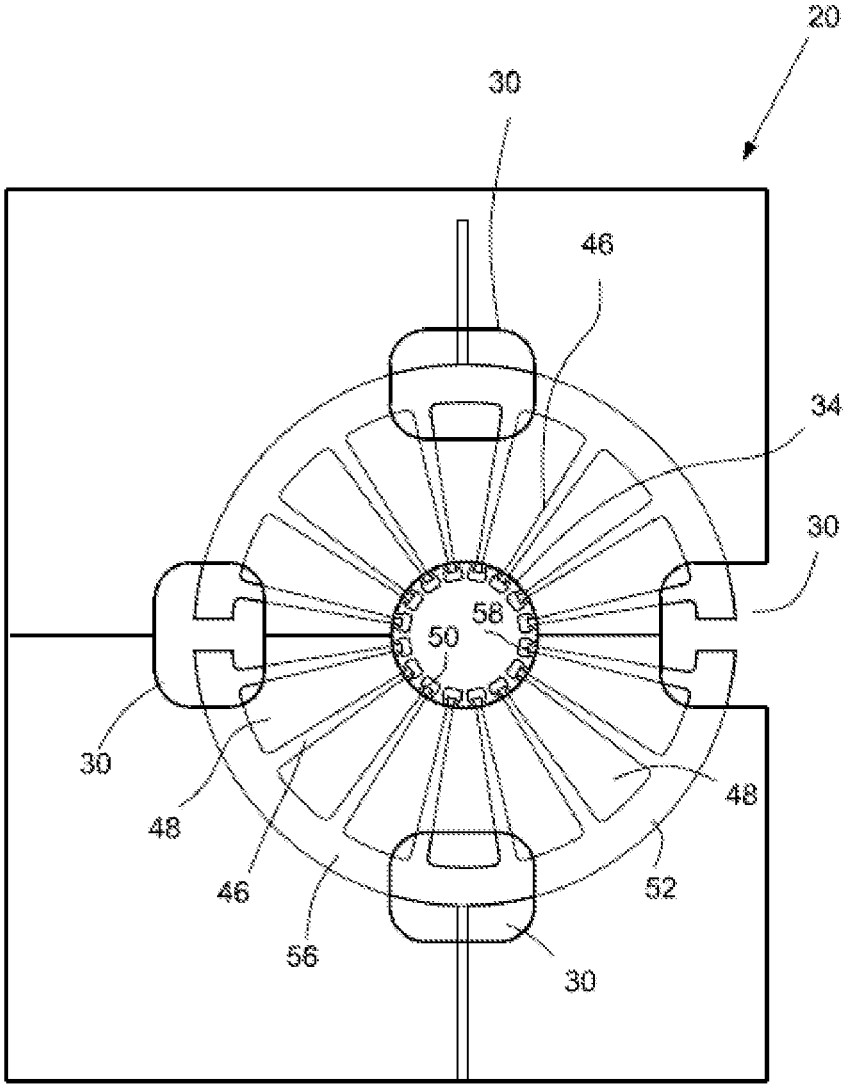
FIG. 11 shows a plan view of an exemplary heater.

Although the fluid passages 46 and the strips 48 of the heating element 24 has thus far been illustrated as being positioned in a rectangular arrangement, the fluid passages 46 and the strips 48 may be arranged in any shape depending on the configuration of the associated cartridge 14. For example, as illustrated in FIG. 11, the fluid passages 46 and the strips 48 may be arranged in a circular pattern.

For the circular configuration, the inner substrate plate 26 (and optionally the outer substrate plate 28) may have one or more inlet passages 30 in direct fluid communication with the fluid distribution zone 54. The fluid distribution zone 52 may include only one common fluid passage 56 located around the circumference of the heating element 24. The common fluid passage 56 may be in direct fluid communication with one or more inlet passages 30 and may be in direct fluid communication with each of the fluid passages 46.

In addition, the fluid passages 46 may converge toward the center of the circle. As such, the strips 48 may be wider toward the circumference of the circle and thinner toward the center of the circle. This may have the effect that the electrical resistivity of the strips 48 gradually increasing toward the center of the circle. Accordingly, the amount of heat generated by the strips 48 may gradually increase toward the center of the circle. The loops 50 and the open areas 58 may be located in close proximity to each other at a central region of the circle at which the outlet passage 34 may be located. Similar to the other arrangements previously discussed, part of each loop 50 may extend into the outlet passage 34 so that only part of the open area 58 is covered by the inner and outer substrate plates 26, 28.

Figure 12:
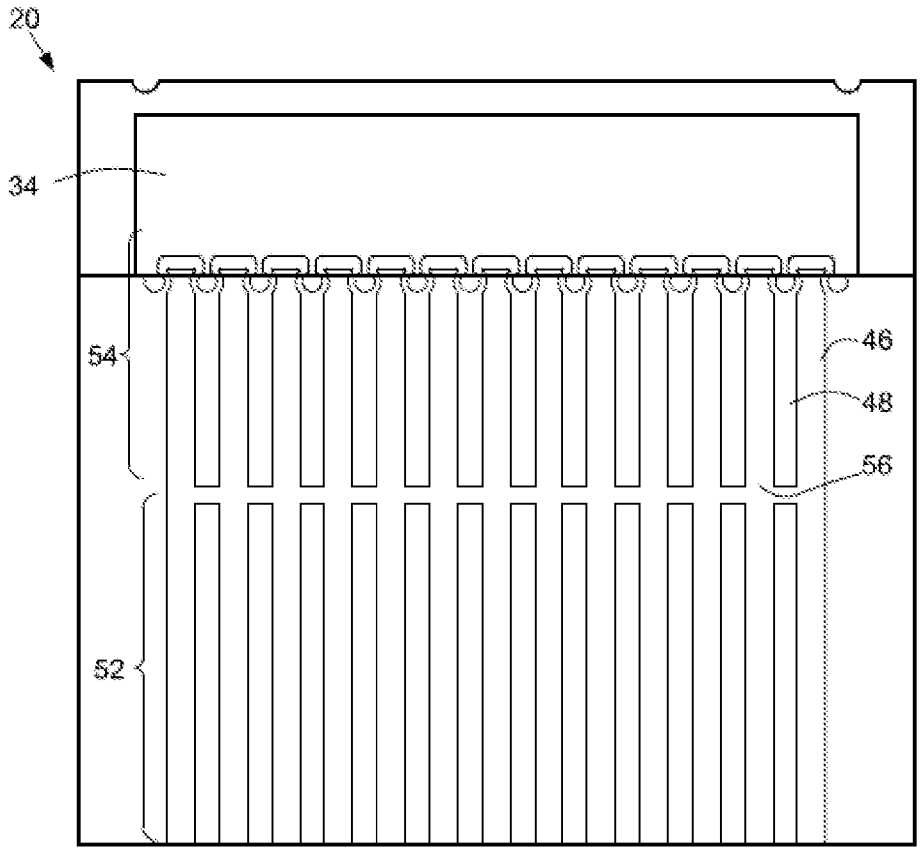
FIG. 12 shows a plan view of an exemplary heater.
Figure 13:
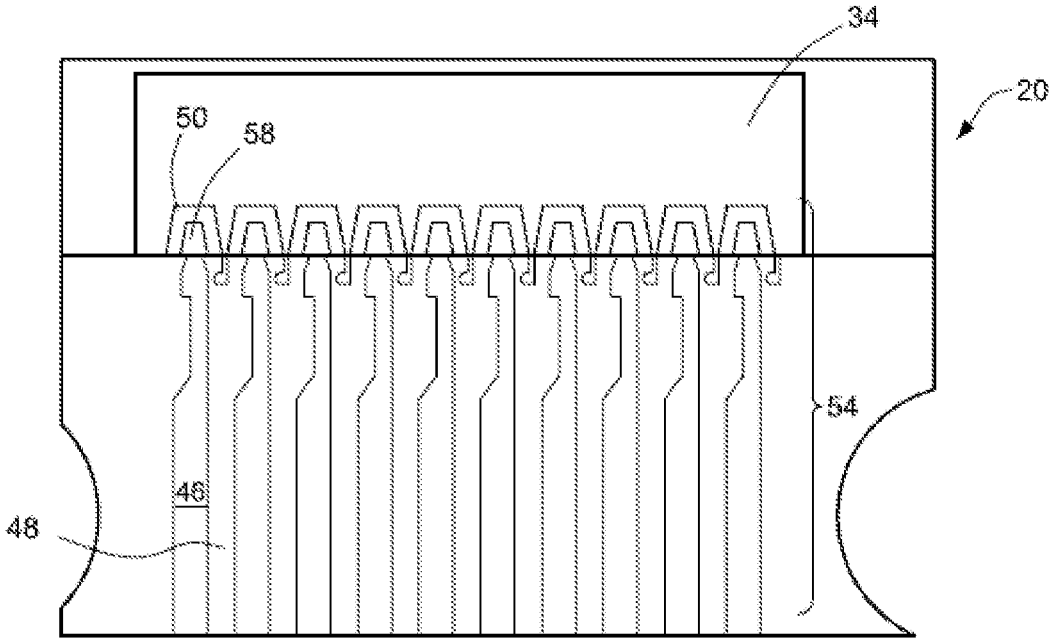
FIG. 13 shows a plan view of an exemplary heater.

FIGS. 12 and 13 show heating elements 24 with differently shaped loops 50. For example, the loops 50 in FIG. 12 may be in the form of flattened loops. The loops 50 in FIG. 13 may be more trapezoidally shaped.

Figure 14:
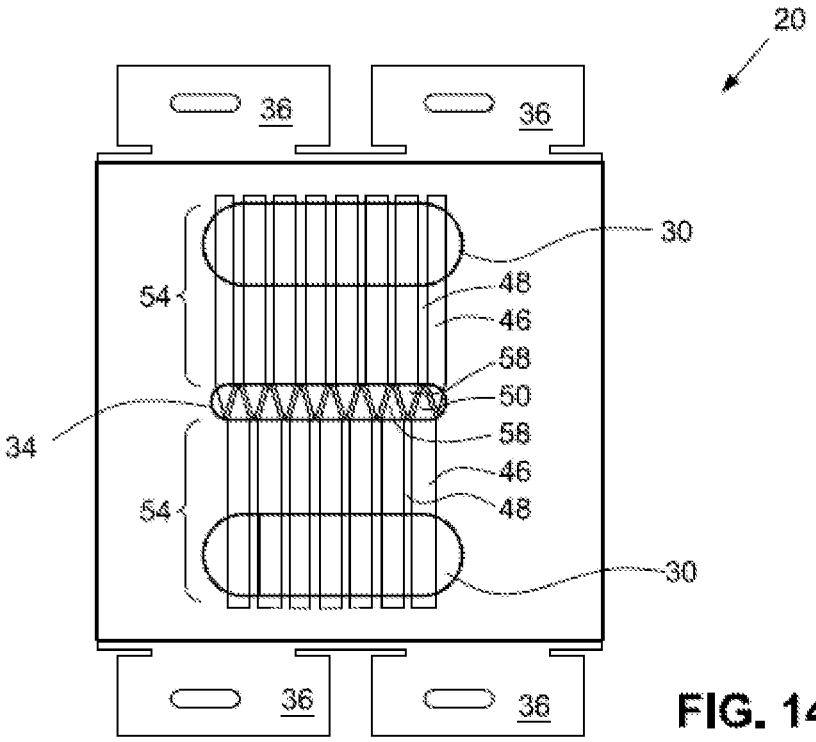
FIG. 14 shows a plan view of an exemplary heater.
Figure 15:
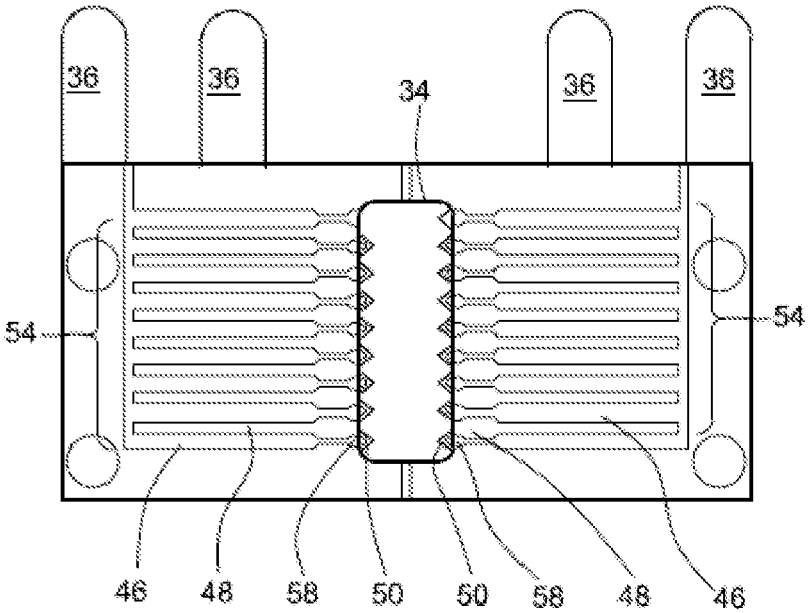
FIG. 15 shows a plan view of an exemplary heater.
Figure 16:
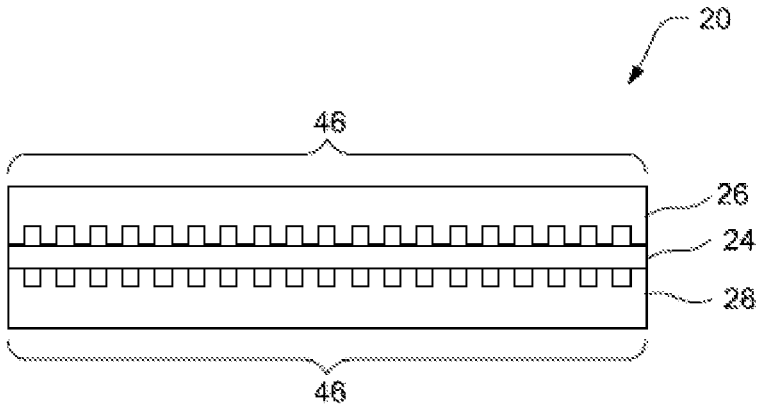
FIG. 16 shows a side view of an exemplary heater with channels etched into substrate plates.

FIGS. 14 and 15 illustrate heater arrangements with a centralized outlet. In such arrangements, inlet passages 30 may be located on opposite sides of the heater 20. The fluid passages 46 and strips 48 may extend from the inlet passages 30 at the edges of the heater 20 to the outlet passage 34 in the center of the heater 20. It should be understood that this arrangement may include two transition zones 54 that may or may not share common loops 50 and open areas 58.

Each transition zone 54 may be associated with a particular set of electrical contacts 36. Although the arrangements illustrated in FIGS. 14 and 15 may include four electrical contacts 36, more or less electrical contacts 36 may be utilized. Accordingly, each transition zone 54 may act as an independently actuated heating zone for multi-zone heating. It is contemplated that each transition zone 54 may be further divided into independently actuated groups of strips 48 and/or loops 50.

It is contemplated that the heating element 24 may include sensors (not shown) strategically positioned in the vaporizing section 32 that may provide temperature, pressure, and/or fluid flow feedback to the electronics in the base 12. The heating element 24 may also include micro valves (not shown) for each fluid passage 46 in order to isolate passages when those passages are not needed due to low demand. The micro valves may also be connected to the electronics in the base 12.

Alternative embodiments of the invention may include printing or etching the fluid passages 46 on or in a surface of one or both of the substrate plates 26, 28; electrically separate strips 50/passages 46 or groups of strips 50/fluid passages 46 to allow selective application of electricity to individual strips 48 or groups of strips 48, and the passages 46/strips 48 may be arranged in straight rows 44 or pie shaped and arranged in a circular array.

It is contemplated that the fluid passages 46 may be divided into more than one group so that the heater 20 may be able to vaporize more than one type of fluid at the same time. For example, the inner substrate plate 26 may define a first group of fluid passages 46, while the outer substrate plate 28 may define a second group of fluid passages 46. The heating element 24 may intervene between the two groups of fluid passages 46 so that the fluids flowing through the two groups of passages 46 are fluidly separated from each other. In this configuration, the first group of fluid passages 46 may receive a first type of fluid, while the second group of fluid passages 46 may receive a second type of fluid. In addition, the two groups of fluid passages 46 may receive the respective types of fluid through their own respective inlets. In addition, the two groups of fluid passages 46 may discharge vapor into their own respective outlets that fluidly communicate with the outlet passage 34. Alternatively, the two groups of fluid passages 46 may share a single inlet and share a single outlet. In the single inlet and outlet configuration, the inlets and outlets may be equipped with valves or other flow regulating device to direct each fluid type through the inlet and toward one of the fluid passage groups. It should be understood that in the single inlet and outlet configuration, the fluids may be supplied to the respective group of fluid passages 46 one at a time. In addition, the different vapors may be combined at the single outlet.

It is further contemplated that the fluid passages 46 may be divided into more than one group so that the heater 20 may be able to generate more than one size of particle in the aerosol. For example, the first group of fluid passages 46 (formed by the inner substrate plate 26) may generate a first size of particle, while the second group of fluid passages 46 (formed by the outer substrate plate 28) may generate a second size of particles.

It is further contemplated that the majority of the heating element 24 may be omitted so that only the loops 50 remain. In this configuration, the inner and outer substrate plates 26, 28 may together form the individual fluid passages 46.

Advantages provided by the above configurations may include increased contact surface area between the heated portions of the strips 48 and the fluid lowing through the fluid passages 46, an ability to adjust the amount of heat applied to the fluid and the amount of fluid applied to strips by selectively heating loops 50 and/or strips 48. The above configurations may also reduce manufacturing cost, and have simplified components as compared to conventional e-cigarette heaters. Other advantages of the above configurations may be that the loops 50 within the same heater may have different sizes so that some loops 50 may form vapor particle having one dimension and loops 50 of another size may form vapor particles with another dimension.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise.

The invention claimed is:

1. A heater assembly configured to heat a liquid to generate an aerosol from a liquid supply, the heater assembly comprising:

a substrate plate;

a heating element supported on the substrate plate, the heating element comprising a layer of electrically conducting material; and a plurality of channels formed by the electrically conducting material so that the plurality of channels are separated from each other by strips of the electrically conducting material, each of the plurality of channels being configured to operate in parallel, wherein each channel is configured to receive the liquid and discharge vapor, wherein the substrate plate and the heating element form a multi-layer configuration, and wherein each strip of electrically conducting material is wider at a first section of an adjacent channel than at a second section of the adjacent channel.

2. The heater assembly of claim 1, wherein the electrically conducting material is configured so that the electrical resistivity of the heating element is greater at a first end of each channel than at the second end of each channel.

3. The heater assembly of claim 1, wherein the electrically conducting material is configured to generate a greater amount of heat at a first end of each channel than at a second end of each channel.

4. The heater assembly of claim 1, wherein the heating element is configured to generate an aerosol with a target particle size.

5. The heater assembly of claim 1, wherein the heating element is configured to generate an aerosol with more than one target particle size.

6. The heater assembly of claim 1, wherein the electrically conducting material is a metal.

7. The heater assembly of claim 1, wherein the substrate plate is glass or acrylic.

8. A cartridge for microvaporizer configured to generate an aerosol from a liquid supply, the cartridge comprising:

a mouthpiece configured to deliver the aerosol to a user's airways;

a reservoir configured to retain the liquid supply; and the heater assembly of claim 1 that is configured to heat the liquid supply.

9. A microvaporizer configured to generate an aerosol from a liquid supply, the microvaporizer comprising:

a cartridge comprising:

a mouthpiece configured to deliver the aerosol to a user's airways;

a reservoir configured to retain the liquid supply; and the heater assembly of claim 1 that is configured to heat the liquid supply; and a base configured to receive the cartridge, the base comprising electronics configured to control and supply power to the heater assembly.

10. A heater assembly configured to heat a fluid to generate an aerosol from the fluid, the heater assembly comprising:

a substrate plate; and a heating element supported on the substrate plate, the heating element comprising a layer of electrically conducting material with a plurality of elongated gaps that are configured to convey the fluid, wherein the substrate plate covers a first section of each elongated gap, wherein the substrate plate comprises an opening that leaves a second section of each elongated gap exposed, wherein the heating element is configured to heat the fluid in the first section of the elongated gaps to a temperature below the vapor transition temperature of the fluid, and wherein the heating element is configured to heat the fluid in the second section of the elongated gaps to a temperature above the vapor transition temperature of the fluid.

11. The heater assembly of claim 10, wherein the heating element is configured to vaporize the fluid in each elongated gap before the fluid reaches the second section of the elongated gap.

12. The heater assembly of claim 11, wherein the substrate plate is electrically non-conductive or dielectric.

13. The heater assembly of claim 11, wherein the elongated gaps are linearly shaped and are positioned in parallel.

14. The heater assembly of claim 11, wherein the elongated gaps are fluidly connected to a common inlet.

15. The heater assembly of claim 11, wherein a wick is positioned within the elongated gaps.

16. The heater assembly of claim 11, wherein a wick is positioned across outlet ends of the elongated gaps.

17. The heater assembly of claim 11, wherein the elongated gaps are directed radially toward a center of the heating element.

18. The heater assembly of claim 10, wherein the elongated gaps are separated from each other by strips of the electrically conducting material.

19. The heater assembly of claim 18, wherein the strips of electrically conducting material are wider at the first sections of the elongated gaps than at the second sections of the elongated gaps.

20. A cartridge for microvaporizer configured to generate an aerosol from a liquid supply, the cartridge comprising:

a mouthpiece configured to deliver the aerosol to a user's airways;

a reservoir configured to retain the liquid supply; and the heater assembly of claim 10.

21. A microvaporizer configured to generate an aerosol from a liquid supply, the microvaporizer comprising:

a cartridge with a mouthpiece, a reservoir, and the heater assembly of claim 10; and a base configured to receive the cartridge, the base comprising electronics configured to control and supply power to the heater assembly.

* * * * *